US011485132B2

(12) United States Patent
Kim et al.

(10) Patent No.: US 11,485,132 B2
(45) Date of Patent: Nov. 1, 2022

(54) METHOD OF MAINTAINING AN INK JET HEAD AND PRINTING METHOD USING AN INK JET HEAD

(71) Applicant: Semes Co., Ltd., Cheonan-si (KR)

(72) Inventors: Chulwoo Kim, Cheonan-si (KR); Sanghwa Lee, Asan-si (KR); Beomjeong Oh, Cheonan-si (KR)

(73) Assignee: Semes Co., Ltd., Cheonan-si (KR)

( * ) Notice: Subject to any disclaimer, the term of this patent is extended or adjusted under 35 U.S.C. 154(b) by 115 days.

(21) Appl. No.: 16/933,029

(22) Filed: Jul. 20, 2020

(65) Prior Publication Data

US 2021/0023836 A1 Jan. 28, 2021

(30) Foreign Application Priority Data

Jul. 24, 2019 (KR) ..... 10-2019-0089285

(51) Int. Cl.
*B41J 2/045* (2006.01)

(52) U.S. Cl.
CPC ..... *B41J 2/0451* (2013.01); *B41J 2/04581* (2013.01)

(58) Field of Classification Search
CPC ..... B41J 29/393; B41J 2/0451; B41J 2/2142
See application file for complete search history.

(56) References Cited

U.S. PATENT DOCUMENTS

2009/0015623 A1* 1/2009 Miyamoto ..... B41J 29/393 347/19

FOREIGN PATENT DOCUMENTS

| | | |
|---|---|---|
| JP | 2007-152895 A | 6/2007 |
| JP | 2007-168296 A | 7/2007 |
| KR | 10-1994-0011215 | 6/1994 |
| KR | 10-1998-0073171 | 11/1998 |
| KR | 10-2000-0008624 | 2/2000 |

* cited by examiner

*Primary Examiner* — Lam S Nguyen
(74) *Attorney, Agent, or Firm* — Daly Crowley Mofford & Durkee, LLP

(57) ABSTRACT

In a printing method using an ink jet head, a chemical liquid may be discharged onto a substrate from a plurality of nozzles of the ink jet head. Discharging numbers of the chemical liquid from the plurality of nozzles may be identified and a cumulative discharging number of the chemical liquid from the plurality of nozzles may be calculated. The cumulative discharging number of the chemical liquid may be compared with a previously set limit discharging number of the ink jet head. A replacement time of the ink jet head may be determined if the cumulative discharging number of the chemical liquid exceeds the previously set limit discharging number.

14 Claims, 3 Drawing Sheets

METHOD OF MAINTAINING AN INK JET HEAD AND PRINTING METHOD USING AN INK JET HEAD

CROSS-REFERENCE TO RELATED APPLICATION

This application claims priority to Korean Patent Application No. 10-2019-0089285 filed on Jul. 24, 2019 in the Korean Intellectual Property Office (KIPO), the contents of which are herein incorporated by reference in its entirety.

BACKGROUND

1. Field

Example embodiments of the invention relate to a method of maintaining an ink jet head and a printing method using an ink jet head. More particularly, example embodiments of the invention relate to a method of maintaining an ink jet head by exactly determining a replacement time of an ink jet head, and a printing method using a suitable ink jet head.

2. Related Technology

To manufacture a display device such as an organic light emitting display device, a printing process for coating chemical liquid on a substrate using an ink jet head capable of discharging the chemical liquid by an ink jet method. Here, the ink jet head is directly related to the printing quality on the substrate so that the ink jet head is replaced when the performance of the ink jet head is deteriorated. Such replacement time of the ink jet head is generally determined depending on the manuals provided by the manufacturers.

The ink jet head is replaced with new ink jet head according to the manuals even though the ink jet head maintains good performance such that the economics and efficiency of the manufacturing apparatuses including the ink jet head can be reduced. Further, the ink jet hear is not replaced when the replacement time of the ink jet head by the manuals is not come even though the performance of the ink jet head is deteriorated. Therefore, the quality and reliability of the display device may be decreased by the ink jet head.

SUMMARY

It is one object of the invention to provide a method of maintaining an ink jet head capable of exactly determining the replacement time of the ink jet head.

It is another object of the invention to provide a printing method using an ink jet head capable of exactly forming desired pixels on a substrate.

According to an aspect of the invention, there is provided a method of maintaining an ink jet head. In the method of maintaining an ink jet head, discharging numbers of the chemical liquid discharged from the ink jet head onto an object may be identified. A cumulative discharging number of the chemical liquid from the ink jet head may be calculated. The cumulative discharging number of the chemical liquid may be compared with a previously set limit discharging number of the ink jet head. A replacement time of the ink jet head may be determined based on the comparison of the cumulative discharging number and previously set limit discharging number.

In example embodiments, the discharging numbers of the chemical liquid may be obtained by counting operating numbers of piezoelectric elements of the ink jet head.

In example embodiments, the cumulative discharging number of the chemical liquid may be calculated by accumulatively counting the operating numbers of the piezoelectric elements of the ink jet head.

In example embodiments, the determining of the replacement time of the ink jet head may be performed if the cumulative discharging number of the chemical liquid exceeds the previously set limit discharging number.

In the determining of the replacement time of the ink jet head according to some example embodiments, it may be determined whether the ink jet head is continuously usable or not.

In the determining of the replacement time of the ink jet head according to some example embodiments, the ink jet head may be replaced with a new ink jet head if the ink jet head is not continuously usable. Alternatively, the previously set limit discharging number of the ink jet head may be reset if the ink jet head is continuously usable.

According to another aspect of the invention, there is provided a printing method using an ink jet head. In the printing method using an ink jet head, a chemical liquid may be discharged onto a substrate from a plurality of nozzles of the ink jet head. Discharging numbers of the chemical liquid from the plurality of nozzles may be identified. Cumulative discharging numbers of the chemical liquid from the plurality of nozzles may be calculated. The cumulative discharging numbers of the chemical liquid may be compared with previously set limit discharging numbers of the plurality of nozzles. A replacement time of the ink jet head may be determined if the cumulative discharging number of the chemical liquid exceeds the previously set limit discharging number.

In example embodiments, the discharging numbers of the chemical liquid may be obtained by counting operating numbers of a plurality of piezoelectric elements of the ink jet head corresponding to the plurality of nozzles, respectively.

In example embodiments, the cumulative discharging numbers of the chemical liquid may be calculated by accumulatively counting the operating numbers of the plurality of piezoelectric elements.

In the determining of the replacement time of the ink jet head according to some example embodiments, it may be determined whether the ink jet head is continuously usable or not.

In the determining of the replacement time of the ink jet head according to some example embodiments, the ink jet head may be replaced with a new ink jet head if the ink jet head is not continuously usable. Alternatively, the previously set limit discharging numbers of the plurality of nozzles may be reset if the ink jet head is continuously usable.

According to still another aspect of the invention, there is provided a printing method using an ink jet head including a plurality of nozzles and a plurality of piezoelectric elements. In the printing method using an ink jet head, a chemical liquid may be discharged onto a substrate from the plurality of nozzles. Discharging numbers of the chemical liquid from the plurality of nozzles may be identified. Cumulative discharging numbers of the chemical liquid from the plurality of nozzles may be calculated. The cumulative discharging numbers of the chemical liquid from the plurality of nozzles may be adjusted if the cumulative discharging numbers of the chemical liquid from the plurality of are different. A replacement time of the ink jet head may be determined if the cumulative discharging numbers of the chemical liquid from the plurality of nozzles exceed previously set limit discharging numbers of the plurality of nozzles.

In the adjusting of the cumulative discharging numbers of the chemical liquid from the plurality of nozzles according to example embodiments, the discharge of the chemical liquid from a nozzle of the plurality of nozzles having a relatively small cumulative discharging number of the chemical liquid may be stopped, and the chemical liquid may be discharged onto the substrate from a nozzle of the plurality of nozzles having a relatively large cumulative discharging number of the chemical liquid after moving the nozzle of the plurality of nozzles having the relatively large cumulative discharging number of the chemical liquid over a discharging point of the substrate corresponding to the nozzle of the plurality of nozzles having the relatively small cumulative discharging number of the chemical liquid.

In example embodiments, the discharging numbers of the chemical liquid from the plurality of nozzles may be obtained by counting operating numbers of the plurality of piezoelectric elements corresponding to the plurality of nozzles, respectively. Additionally, the cumulative discharging numbers of the chemical liquid from the plurality of nozzles may be calculated by accumulatively counting the operating numbers of the plurality of piezoelectric elements.

In the determining of the replacement time of the ink jet head according to example embodiments, the ink jet head may be replaced with a new ink jet head if the ink jet head is not continuously usable, or the previously set limit discharging numbers of the plurality of nozzles may be reset if the ink jet head is continuously usable.

In example embodiments, before the replacement time of the ink jet head is determined, the cumulative discharging numbers of the chemical liquid from the plurality of nozzles may be compared with the previously set limit discharging numbers of the plurality of nozzles.

In the comparing of the cumulative discharging numbers of the chemical liquid from the plurality of nozzles with the previously set limit discharging numbers of the plurality of nozzles according to example embodiments, it may be identified whether the cumulative discharging numbers of the chemical liquid from the plurality of nozzles exceed the previously set limit discharging numbers of the plurality of nozzles, or not.

In some example embodiments, if a cumulative discharging number of the chemical liquid from one nozzle of the plurality of nozzles exceeds a previously set limit discharging number of the one nozzle, and a cumulative discharging number of the chemical liquid from another nozzle of the plurality of nozzles exceeds a previously set limit discharging number of the another nozzle, the discharge of the chemical liquid from the one nozzle may be stopped and the chemical liquid may be discharged onto the substrate from the another nozzle after moving the another nozzle over a discharging point of the substrate corresponding to the one nozzle.

In some example embodiments, the ink jet head may be replaced with a new ink jet head if cumulative discharging numbers of the chemical liquid from nozzles of the plurality of nozzles more than predetermined nozzles exceed previously set limit discharging numbers of the nozzles.

According to example embodiments, the replacement time of the ink jet head may be determined based on the cumulative discharging number of the chemical liquid from the ink jet head and the previously set limit discharging number of the ink jet head such that the efficiency of the manufacturing line including the ink jet head may be enhanced. Additionally, the replacement time of the ink jet head may be exactly determined in the printing method using the ink jet head so that the desired pixels of the display device may be precisely formed on the substrate. Moreover, the ink jet head may be economically maintained since the replacement of the ink jet head may be determined after the continuous use of the ink jet head is decided even though the cumulative discharging number of the chemical liquid exceeds the previously set limit discharging number.

BRIEF DESCRIPTION OF THE DRAWINGS

Example embodiments will be more clearly understood from the following detailed description taken in conjunction with the accompanying drawing. The following figures represent non-limiting, example embodiments as described herein.

DESCRIPTION OF EMBODIMENTS

Figure 1:
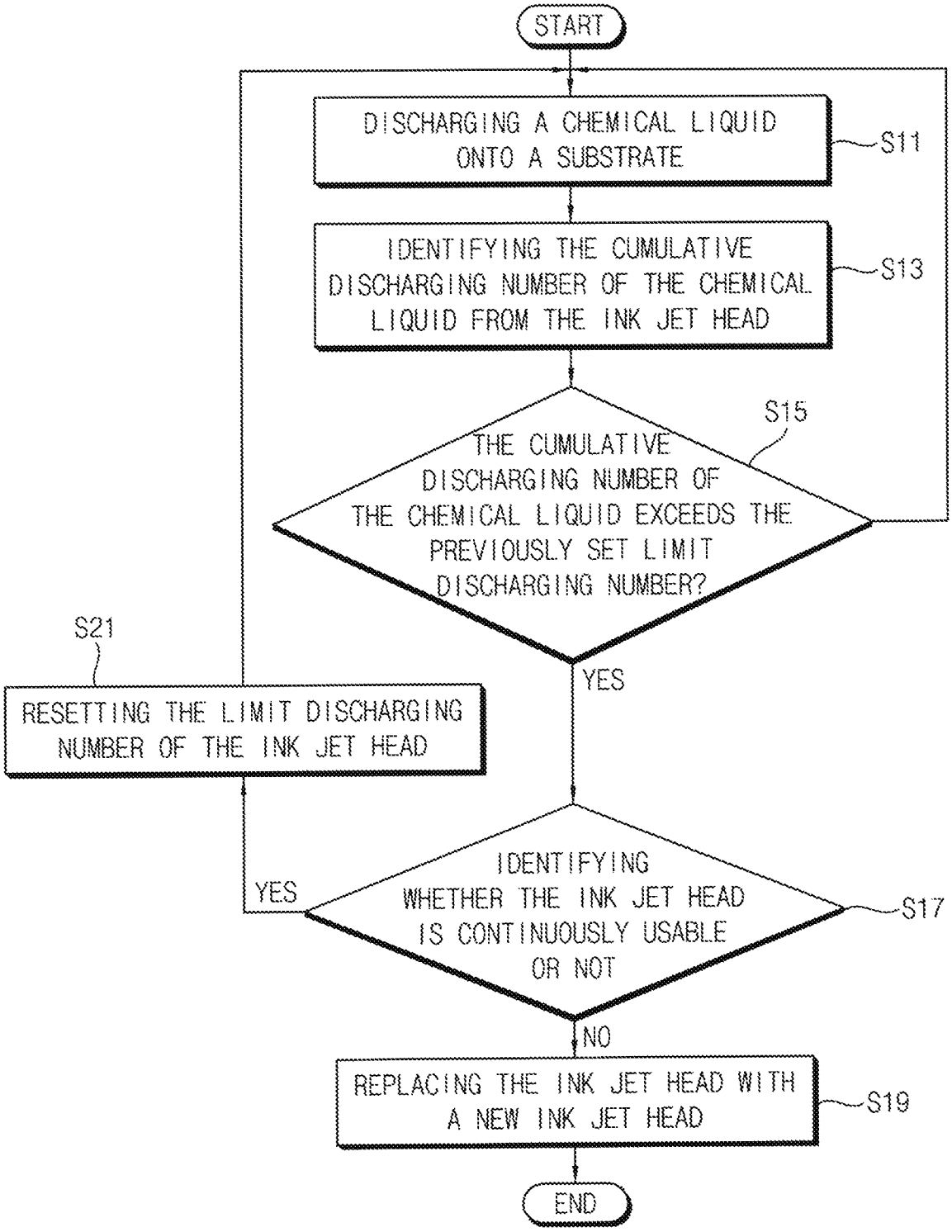
FIG. 1 is a block diagram illustrating a printing method using an ink jet head in accordance with example embodiments of the invention.

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, it will be described a method of maintaining an ink jet head and a printing method using an ink jet head according to example embodiments with reference to the accompanying drawings.

In example embodiments, the ink jet head may include a plurality of nozzles which may provide chemical liquid onto desired regions of an object. In this case, the plurality of nozzles may be arranged on one face of the ink jet head by substantially constant intervals. For example, the plurality of nozzles may be substantially arranged on a bottom face of the ink jet head in a configuration of one line or two lines.

According to example embodiments, the ink jet head may include a plurality of driving members. For example, the ink jet head may include the plurality of driving members corresponding to the plurality of nozzles, respectively. Here, each of the driving members may include a piezoelectric element. In the ink jet head, the number of the nozzles may be substantially the same as the number of the piezoelectric elements. The chemical liquid may be supplied from the plurality of nozzles onto the regions of the object by the operations of the plurality of piezoelectric elements.

The ink jet head according to example embodiments may be employed in a printing process wherein the chemical liquid is provided onto the object such as a substrate for manufacturing a display device such as an organic light emitting display device, a liquid crystal display device, etc. Particularly, the ink jet head may be used in a printing process of forming red, green and blue pixels on a substrate for manufacturing the organic light emitting display device.

According to example embodiments, the time for replacing a previous ink jet head with a new ink jet head may be precisely determined such that ink jet heads used in the printing method may be properly maintained. Therefore, the reliability of the printing method may be enhanced.

FIG. 1 is a block diagram illustrating a printing method using an ink jet head in accordance with example embodiments of the invention.

Referring to FIG. 1, in step S11, a chemical liquid may be supplied onto an object using an ink jet head. In other words, a printing method for discharging the chemical liquid onto the object such as a substrate may be performed using the ink jet head.

In example embodiments, the discharging numbers of the chemical liquid from the ink jet head may be identified while the chemical liquid is discharged from the ink jet head onto the substrate. That is, the discharging numbers of the chemical liquid from the nozzles of the ink jet head onto the substrate may be counted when the chemical liquid is supplied from the ink jet head onto the substrate. Such discharging numbers of the chemical liquid may be obtained by counting the operating numbers of the piezoelectric elements capable of driving the nozzles of the ink jet head to discharge the chemical liquid onto the substrate. In this case, the discharging numbers of the chemical liquid may be continuously counted in the printing process performed using the ink jet head.

In step S13, the cumulative discharging number of the chemical liquid may be identified by continuously counting the discharging number of the chemical liquid while discharging the chemical liquid onto the substrate. This cumulative discharging number of the chemical liquid may be calculated by accumulatively the operating numbers of the piezoelectric elements while the chemical liquid is discharged onto the substrate from the nozzles of the ink jet head.

According to example embodiments, the ink jet head may include the plurality of nozzles and the plurality of piezoelectric elements corresponding to the plurality of nozzles so that the discharging numbers of the chemical liquid from the nozzles may be determined by counting the operating numbers of the plurality of piezoelectric elements which may drive the plurality of nozzles, respectively. Further, the cumulative discharging number of the chemical liquid may be calculated by summing the operating numbers of the piezoelectric elements while the chemical liquid is discharged from the nozzles onto the substrate.

The available time of the ink jet head may be mainly determined based on the discharging numbers of the chemical liquid from the nozzles of the ink jet head, namely the operating numbers of the piezoelectric elements of the ink jet head. In example embodiments, the discharging numbers of the chemical liquid and the cumulative discharging number of the chemical liquid may be identified based on the operating numbers of the piezoelectric elements, and thus that the available time and conditions of the ink jet head may be determined. Accordingly, the replacement time of the ink jet head may be determined by deciding the conditions and the available time of the ink jet head based on the identification of the operating numbers of the piezoelectric elements. In other words, the time for replacing the present ink jet head with a new ink jet head may be determined based on the discharging numbers of the chemical liquid and the cumulative discharging number of the chemical liquid from the present ink jet head.

In example embodiments, the operating numbers of the piezoelectric elements may be calculated by means of multiplying the discharging time of the chemical liquid by the output frequency for discharging the chemical liquid from the nozzles of the ink jet head. In some example embodiments, the operating numbers of the piezoelectric elements may be calculated using the sizes of the images of the chemical liquid which may be formed on the substrate by the discharge of the chemical liquid from the nozzles of the ink jet head. The calculation of the operating numbers of the piezoelectric elements based on the output frequency or the sizes of the images of the chemical liquid may be accomplished using predetermined software for controlling the ink jet head. Therefore, the replacement time of the ink jet head may be exactly determined and the ink jet head may be properly maintained in the printing method.

Referring now to FIG. 1, in step S15, the cumulative discharging number of the chemical liquid from the ink jet head may be compared with a previously set limit discharging number of the ink jet head. That is, it may be identified whether the cumulative discharging number of the chemical liquid exceeds the previously set limit discharging number, or not. In this case, the previously set limit discharging number of the ink jet head may be provided from the manufacturer, or the previously set limit discharging number of the ink jet head may be empirically determined in the manufacturing line employing the ink jet head for manufacturing the display device. In example embodiments, the previously set limit discharging number of the ink jet head may be feed backed to continuously the reset previously set limit discharging number based on the maximum values where the ink jet head may be continuously used as described below.

In step S15, if the cumulative discharging number of the chemical liquid from the ink jet head does not exceed the previously set limit discharging number of the ink jet head, it may be determined that the ink jet head may be continuously usable. Then, the step S11 to the step S15 may be repeatedly performed on the substrate. Alternatively, the replacement time of the ink jet head may be determined if the cumulative discharging number of the chemical liquid exceeds the previously set limit discharging number.

In example embodiments, the determination of the replacement time for the ink jet head may be accomplished by deciding whether the ink jet head may be continuously usable, or not.

In step S17, if the cumulative discharging number of the chemical liquid from the ink jet head exceeds the previously set limit discharging number of the ink jet head, it may be identified whether the ink jet head may be continuously usable or not. Although the cumulative discharging number of the chemical liquid exceeds the previously set limit discharging number, the ink jet head may continuously discharge the chemical liquid onto the substrate. Particularly, the previously set limit discharging number provided by the manufacturer may be different from the previously set limit discharging number empirically obtained in the manufacturing line. Therefore, it may be identified whether the ink jet head may be continuously usable or not even though the cumulative discharging number of the chemical liquid exceeds the previously set limit discharging number.

In step S19, the ink jet head may be replaced with a new ink jet head if the continuous use of the ink jet head is impossible. For example, an alarm may be provided to a user so as to notify the replacement time of the ink jet head, and thus the user may replace the previous ink jet head with the new ink jet head.

In some example embodiments, the alarm may be provided to the user when the cumulative discharging number of the chemical liquid from the ink jet head exceeds the previously set limit discharging number of the ink jet head.

In step S21, if the continuous use of the ink jet head is possible, a new limit discharging number of the ink jet head may be reset based on the previously set limit discharging number may be reset. In example embodiments, although the cumulative discharging number of the chemical liquid exceeds the previously set limit discharging number, the ink jet head may be continuously used without the replacement of the ink jet head if the ink jet head is usable. Simultaneously, the limit discharging number of the ink jet head may be reset using the predetermined software. In other words, the chemical liquid may be discharged from the ink jet head onto the substrate by performing the step S11 to the step S17, and simultaneously the new limit discharging number of the ink jet head may be reset when the ink jet head is continuously usable even though the cumulative discharging number of the chemical liquid exceeds the previously set limit discharging number. For example, the new limit discharging number of the ink jet head may be reset based on the value empirically obtained in the manufacturing line for the display device.

As described above, the replacement time of the ink jet head may be determined based on the cumulative discharging number of the chemical liquid from the ink jet head and the previously set limit discharging number of the ink jet head such that the efficiency of the manufacturing line including the ink jet head may be enhanced. Additionally, the replacement time of the ink jet head may be exactly determined in the printing method using the ink jet head so that the desired pixels of the display device may be precisely formed on the substrate. Moreover, the ink jet head may be economically maintained since the replacement of the ink jet head may be determined after the continuous use of the ink jet head is decided even though the cumulative discharging number of the chemical liquid exceeds the previously set limit discharging number.

Hereinafter, it will be described a printing method using an ink jet head including a plurality of nozzles and a plurality of piezoelectric elements according to example embodiments with reference to the accompanying drawings.

Figure 2:
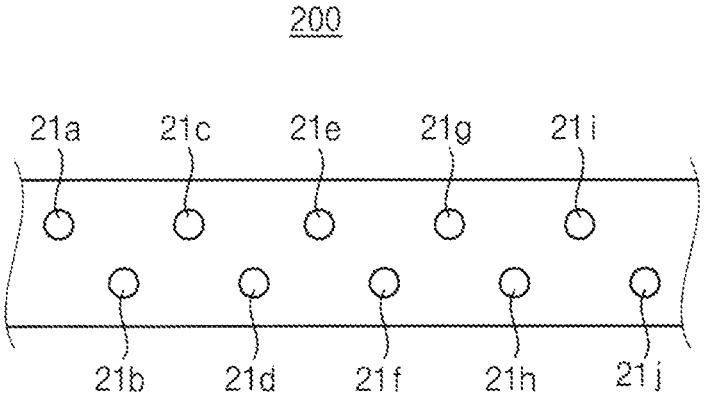
FIGS. 2 to 4 are schematic drawings illustrating a printing method using an ink jet head including a plurality of nozzles and a plurality of piezoelectric elements in accordance with some example embodiments of the invention.
Figure 3:
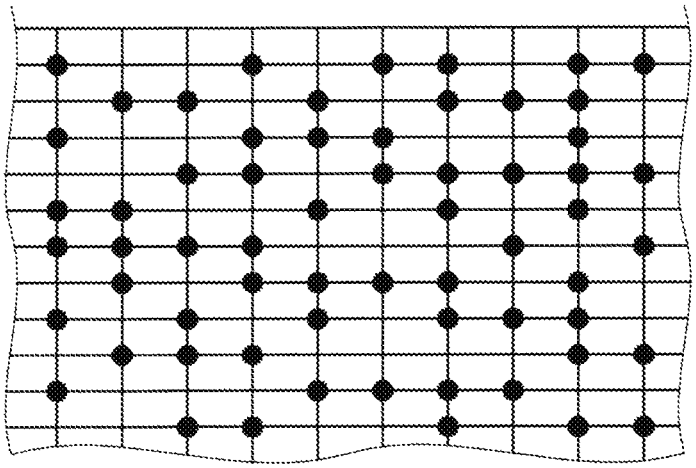
Figure 4:
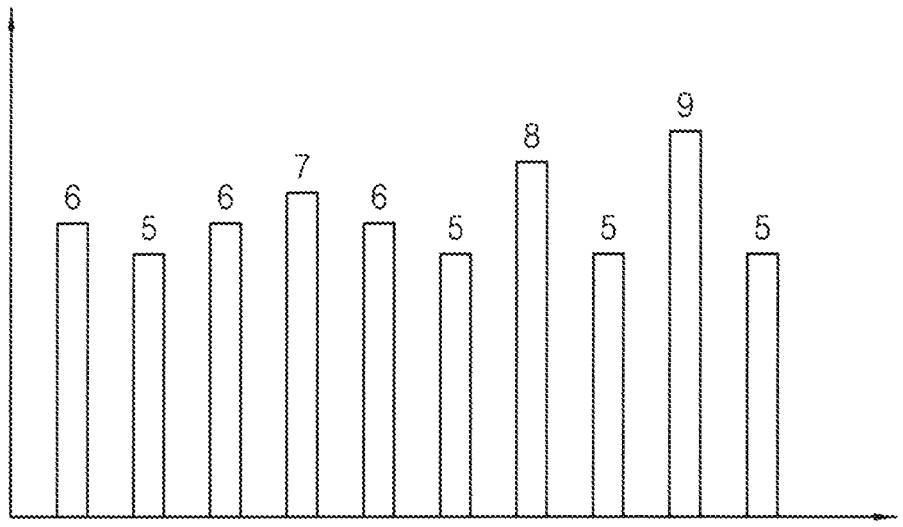

FIGS. 2 to 4 are schematic drawings illustrating a printing method using an ink jet head including a plurality of nozzles and a plurality of piezoelectric elements in accordance with some example embodiments of the invention.

Referring to FIG. 2, an ink jet head 200 according to some example embodiments may include a plurality of nozzles (21*a*, 21*b*, 21*c*, 21*d*, 21*e*, 21*f*, 21*g*, 21*h*, 21*i*, 21*j*). For example, the ink jet head 200 may include about 1,024 nozzles. In this case, the plurality of nozzles (21*a*, 21*b*, 21*c*, 21*d*, 21*e*, 21*f*, 21*g*, 21*h*, 21*i*, 21*j*) may be arranged in a configuration substantially including two lines.

FIG. 3 illustrates discharging points of a substrate onto which chemical liquid is discharged from the ink jet head 200 in FIG. 2, namely the discharging points of the chemical liquid. The plurality of nozzles (21*a* to 21*j*) of the ink jet head 200 may not discharge the chemical liquid onto the substrate by the same discharging numbers, however, the plurality of nozzles (21*a* to 21*j*) may discharge the chemical liquid onto the substrate by different discharging numbers so that the arbitrary printed images of the chemical liquid may be formed on the substrate as illustrated in FIG. 3.

FIG. 4 illustrates the discharging numbers of the chemical liquid from the plurality of nozzles (21*a* to 21*j*) of the ink jet head 200 illustrated in FIG. 2. As illustrated in FIG. 4, it may be identified that the discharging numbers of the chemical liquid from plurality of nozzles (21*a* to 21*j*) are substantially different while the chemical liquid is discharged onto the substrate from the plurality of nozzles (21*a* to 21*j*).

Hereinafter, a printing method of forming arbitrary printed images on a substrate using an ink jet head including a plurality of nozzles and a plurality of piezoelectric elements.

Chemical liquid may be discharged onto a substrate from the plurality of nozzles (21*a* to 21*j*) of the ink jet head 200 illustrated in FIG. 2. Particularly, the plurality of nozzles (21*a* to 21*j*) may discharge the chemical liquid onto the substrate by substantially different discharging numbers of the chemical liquid. Therefore, the arbitrary printed images of the chemical liquid may be formed on the substrate as illustrated in FIG. 3.

Then, the discharging numbers of the chemical liquid from the ink jet head 200 may be identified. That is, the discharging numbers of the chemical liquid from the plurality of nozzles (21*a* to 21*j*) may be counted while the chemical liquid is discharged onto the substrate. As described above, the discharging numbers of the chemical liquid may be obtained by counting the operating numbers of the piezoelectric elements for driving the plurality of nozzles (21*a* to 21*j*).

The discharging numbers of the chemical liquid from the plurality of nozzles (21*a* to 21*j*) may be continuously counted. Thus, the cumulative discharging numbers of the chemical liquid from the plurality of nozzles (21*a* to 21*j*) may be calculated. In this case, the cumulative discharging numbers of the chemical liquid from the plurality of nozzles (21*a* to 21*j*) may be calculated by accumulatively counting the operating numbers of the piezoelectric elements.

When the cumulative discharging numbers of the chemical liquid from the plurality of nozzles (21*a* to 21*j*) are identified, the cumulative discharging numbers of the chemical liquid from the plurality of nozzles (21*a* to 21*j*) may be substantially different. For example, the cumulative discharging number of the chemical liquid from one of the plurality of nozzles (21*a* to 21*j*) may be substantially greater than the cumulative discharging number of the chemical liquid from the other of the plurality of nozzles (21*a* to 21*j*).

In the ink jet head 200 illustrated in FIG. 3 and FIG. 4, it can be identified that each of the cumulative discharging numbers of the chemical liquid from a first nozzle 21*a*, a third nozzle 21*c* and a fifth nozzle 21*e* is 6, and each of the cumulative discharging numbers of the chemical liquid from a second nozzle 21*b*, a sixth nozzle 21*f*, an eighth nozzle 21*h* and a tenth nozzle 21*j* is 5. Additionally, it can be identified that the cumulative discharging number of the chemical liquid from a fourth nozzle 21*d* is 7, the cumulative discharging number of the chemical liquid from a seventh nozzle 21*g* is 8, and the cumulative discharging number of the chemical liquid from a ninth nozzle 21*j* is 9.

In example embodiments, the cumulative discharging numbers of the chemical liquid from the plurality of nozzles (21*a* to 21*j*) may be adjusted or may be averaged when the cumulative discharging number of the chemical liquid from one of the plurality of nozzles (21*a* to 21*j*) is relatively greater than the cumulative discharging numbers of the chemical liquid from others of the plurality of nozzles (21*a* to 21*j*). For example, the discharge of the chemical liquid from one of the plurality of nozzles (21*a* to 21*j*) having the relatively large cumulative discharging number of the chemical liquid. Thus, the cumulative discharging numbers of the chemical liquid from the plurality of nozzles (21*a* to 21*j*) may become substantially equal or may be substantially averaged.

In the ink jet head 200 illustrated in FIG. 3 and FIG. 4, the discharge of the chemical liquid from the seventh nozzle 21*g* may be stopped and the chemical liquid may be discharged onto the substrate from the eighth nozzle 21*h* after moving the eighth nozzle 21*h* over the discharging point of the chemical liquid corresponding to the seventh nozzle 21*g*. Additionally, the discharge of the chemical liquid from the ninth nozzle 21*i* may be stopped and the chemical liquid may be discharged onto the substrate from the tenth nozzle 21*j* after moving the tenth nozzle 21*j* over the discharging point of the chemical liquid corresponding to the ninth nozzle 21*i*. Therefore, the cumulative discharging numbers of the chemical liquid from the plurality of nozzles (21*a* to 21*j*) may become substantially equal or may be substantially averaged.

Then, it may be identified whether the cumulative discharging numbers of the chemical liquid from the plurality of nozzles (21*a* to 21*j*) exceed the previously set limit discharging numbers of the plurality of nozzles (21*a* to 21*j*), or not. The plurality of nozzles (21*a* to 21*j*) may have substantially different discharging numbers of the chemical liquid and substantially different cumulative discharging numbers of the chemical liquid, so that the cumulative discharging number of the chemical liquid from one of the plurality of nozzles (21*a* to 21*j*) may exceed the previously set limit discharging number whereas the cumulative discharging numbers of the chemical liquid from others of the plurality of nozzles (21*a* to 21*j*) may not exceed the previously set limit discharging numbers.

If the cumulative discharging number of the chemical liquid from one nozzle of the plurality of nozzles (21*a* to 21*j*) exceeds the previously set limit discharging number, and the cumulative discharging number of the chemical liquid from another nozzle of the plurality of nozzles (21*a* to 21*j*) does not exceed the previously set limit discharging number, the discharge of the chemical liquid from the one nozzle may be stopped and the chemical liquid may be discharged onto the substrate from the another nozzle after moving the another nozzle over the discharging point of the chemical liquid corresponding to the one nozzle.

If the cumulative discharging numbers of the chemical liquid from the nozzles of the plurality of nozzles (21*a* to 21*j*) more than predetermined nozzles exceed the previously set limit discharging numbers, the replacement of the ink jet head 200 may be determined. For example, when the ink jet head 200 includes about 1,024 nozzles, the ink jet head 200 may be replaced with new ink jet head if more than 517 nozzles have the cumulative discharging numbers of the chemical liquid exceeding the previously set limit discharging numbers of the nozzles.

The previously set limit discharging numbers of the plurality of nozzles (21*a* to 21*j*) may be reset based on the maximum values where the ink jet head 200 may be continuously usable. For example, it may be determined that the ink jet head 200 is continuously usable if the cumulative discharging numbers of the chemical liquid from the plurality of nozzles (21*a* to 21*j*) do not exceed the previously set limit discharging numbers of the plurality of nozzles (21*a* to 21*j*).

As described above, the replacement time of the ink jet head 200 may be decided based on the cumulative discharging numbers of the chemical liquid from the plurality of nozzles (21*a* to 21*j*) and the previously set limit discharging numbers of the plurality of nozzles (21*a* to 21*j*), so that the economics and efficiency of the manufacturing line including the ink jet head 200 may be improved. Further, the ink jet head 20 may be effectively maintained by adjusting or averaging the cumulative discharging numbers of the chemical liquid from the plurality of nozzles (21*a* to 21*j*). Moreover, the desired pixels of the display device may be exactly formed on the substrate by the printing method using the ink jet head 200.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A printing method using an ink jet head, the printing method comprising:

discharging a chemical liquid onto a substrate from a plurality of nozzles of the ink jet head;

calculating cumulative discharging numbers for the plurality of nozzles;

comparing the cumulative discharging numbers with previously set limit numbers for the plurality of nozzles, wherein each of the cumulative discharging numbers is compared to a corresponding one of the limit numbers; and determining whether to replace the ink jet head based on a count of cumulative discharging numbers that exceed their corresponding threshold numbers.

2. The printing method using an ink jet head according to claim 1, wherein the discharging numbers of the chemical liquid are obtained by counting operating numbers of a plurality of piezoelectric elements of the ink jet head corresponding to the plurality of nozzles, respectively.

3. The printing method using an ink jet head according to claim 2, wherein the cumulative discharging numbers of the chemical liquid are calculated by accumulatively counting the operating numbers of the plurality of piezoelectric elements.

4. The printing method using an ink jet head according to claim 1, wherein determining whether to replace the ink jet head includes determining whether the ink jet head is continuously usable.

5. The printing method using an ink jet head according to claim 4, wherein determining whether to replace the ink jet head includes detecting whether the count exceeds a threshold and detecting whether the ink jet is continuously usable, the printing method further comprising replacing the ink jet head with a new ink jet head when the count exceeds the threshold and the ink jet head is not continuously usable.

6. The printing method using an ink jet head according to claim 1, wherein the ink jet head is replaced when the count exceeds a threshold.

7. A printing method using an ink jet head including a plurality of nozzles and a plurality of piezoelectric elements, the printing method comprising:

discharging a chemical liquid onto a substrate from the plurality of nozzles;

calculating cumulative discharging numbers for the plurality of nozzles; and when a cumulative discharging number for a first one of the plurality of nozzles exceeds a corresponding limit for the first nozzle, and a cumulative discharging number for a second one of the plurality of nozzles exceeds a previously set limit for the second nozzle, stopping the discharge of the chemical liquid from the first nozzle and discharging the chemical liquid onto the substrate from the second nozzle after moving the second nozzle over a discharging point of the substrate that corresponds to the first nozzle; and determining whether to replace the ink jet head based on the cumulative discharging numbers.

8. The printing method using an ink jet head according to claim 7, wherein the discharging numbers of the chemical liquid from the plurality of nozzles are obtained by counting operating numbers of the plurality of piezoelectric elements corresponding to the plurality of nozzles, respectively.

9. The printing method using an ink jet head according to claim 8, wherein the cumulative discharging numbers of the chemical liquid from the plurality of nozzles are calculated by accumulatively counting the operating numbers of the plurality of piezoelectric elements.

10. The printing method using an ink jet head according to claim 7, wherein determining whether to replace the ink jet head includes detecting whether a count of the cumulative discharging numbers that exceed respective limit numbers and detecting whether the ink jet is continuously usable, the printing method further comprising replacing the ink jet head with a new ink jet head when the count meets the threshold the ink jet head is not continuously usable.

11. The printing method using an ink jet head according to claim 7, wherein determining whether to replace the inkjet head includes comparing the cumulative discharging numbers of the chemical liquid from the plurality of nozzles with the previously set limit discharging numbers of the plurality of nozzles.

12. The printing method using an ink jet head according to claim 11, further comprising comparing the cumulative discharging numbers with previously set limit discharging numbers for the plurality of nozzles, wherein each of the cumulative discharging numbers is compared to a corresponding previously set limit discharging number, wherein the determining of whether to replace the ink jet head is based on a count of cumulative discharging numbers that exceed their corresponding previously set limit discharging numbers.

13. The printing method using an ink jet head according to claim 12, wherein the ink jet head is replaced when the count exceeds a threshold.

14. A printing method using an ink jet head including a plurality of nozzles and a plurality of piezoelectric elements, the printing method comprising:

discharging a chemical liquid onto a substrate from the plurality of nozzles;

identifying discharging numbers of the chemical liquid from the plurality of nozzles;

calculating cumulative discharging numbers of the chemical liquid from the plurality of nozzles;

if a cumulative discharging number of the chemical liquid from one nozzle of the plurality of nozzles exceeds a previously set limit discharging number of the one nozzle, and a cumulative discharging number of the chemical liquid from another nozzle of the plurality of nozzles exceeds a previously set limit discharging number of the another nozzle, stopping the discharge of the chemical liquid from the one nozzle and discharging the chemical liquid onto the substrate from the another nozzle after moving the another nozzle over a discharging point of the substrate corresponding to the one nozzle; and determining whether to replace the ink jet head based on whether the cumulative discharging numbers exceed previously set limit discharging numbers for the plurality of nozzles.

* * * * *